US005416679A

United States Patent [19]

Ruskouski et al.

[11] Patent Number: 5,416,679

[45] Date of Patent: May 16, 1995

[54] MOUNTING BASE ASSEMBLY FOR A LIGHTING DEVICE USED IN AN EXIT SIGN

[75] Inventors: Charles R. Ruskouski, Danbury; James J. Burnes, Deep River, both of Conn.

[73] Assignee: General Signal Corporation, Stamford, Conn.

[21] Appl. No.: 160,423

[22] Filed: Dec. 1, 1993

[51] Int. Cl.[6] ..... F21V 21/14

[52] U.S. Cl. ..... 362/240; 362/20; 362/269; 362/368; 362/800; 362/250; 362/812; 40/570

[58] Field of Search ..... 362/427, 20, 269, 287, 362/285, 368, 800, 240, 246, 250, 812, 273, 31, 239, 234; 40/570, 564, 580, 573

[56] References Cited

U.S. PATENT DOCUMENTS 739,845 9/1903 Evans ..... 362/35 X
849,574 4/1907 Ruger ..... 362/35
4,953,067 8/1990 Moore ..... 362/812 X
4,965,457 10/1990 Wrobel et al. ..... 362/457 X
5,018,290 5/1991 Kozek et al. ..... 40/570
5,160,201 11/1992 Wrobel ..... 362/249
5,268,828 12/1993 Miura ..... 362/249
5,303,124 4/1994 Wrobel ..... 362/249

*Primary Examiner*—James C. Yeung
*Assistant Examiner*—Thomas M. Sember
*Attorney, Agent, or Firm*—Ware, Fressola, Van Der Sluys & Adolphson

[57] ABSTRACT

In a lighting fixture such as an exit sign, a mounting base assembly is provided on a light emitting diode lighting device for mating engagement with an electrical socket. Once full mating engagement is achieved between the electrical socket and a base member of the mounting base assembly, the position of the housing carrying the light emitting diodes of the lighting device can be adjusted for alignment purposes without disturbing the full mating engagement of the electrical socket and the base member.

38 Claims, 4 Drawing Sheets

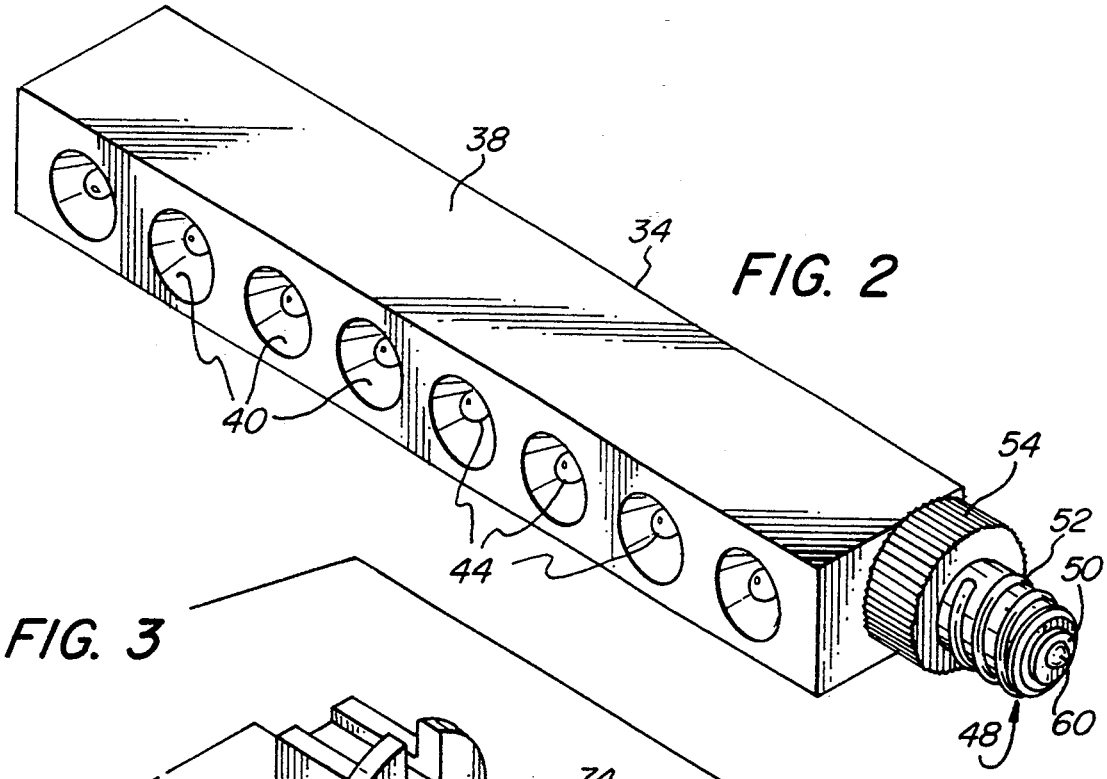
FIG. 2
FIG. 3
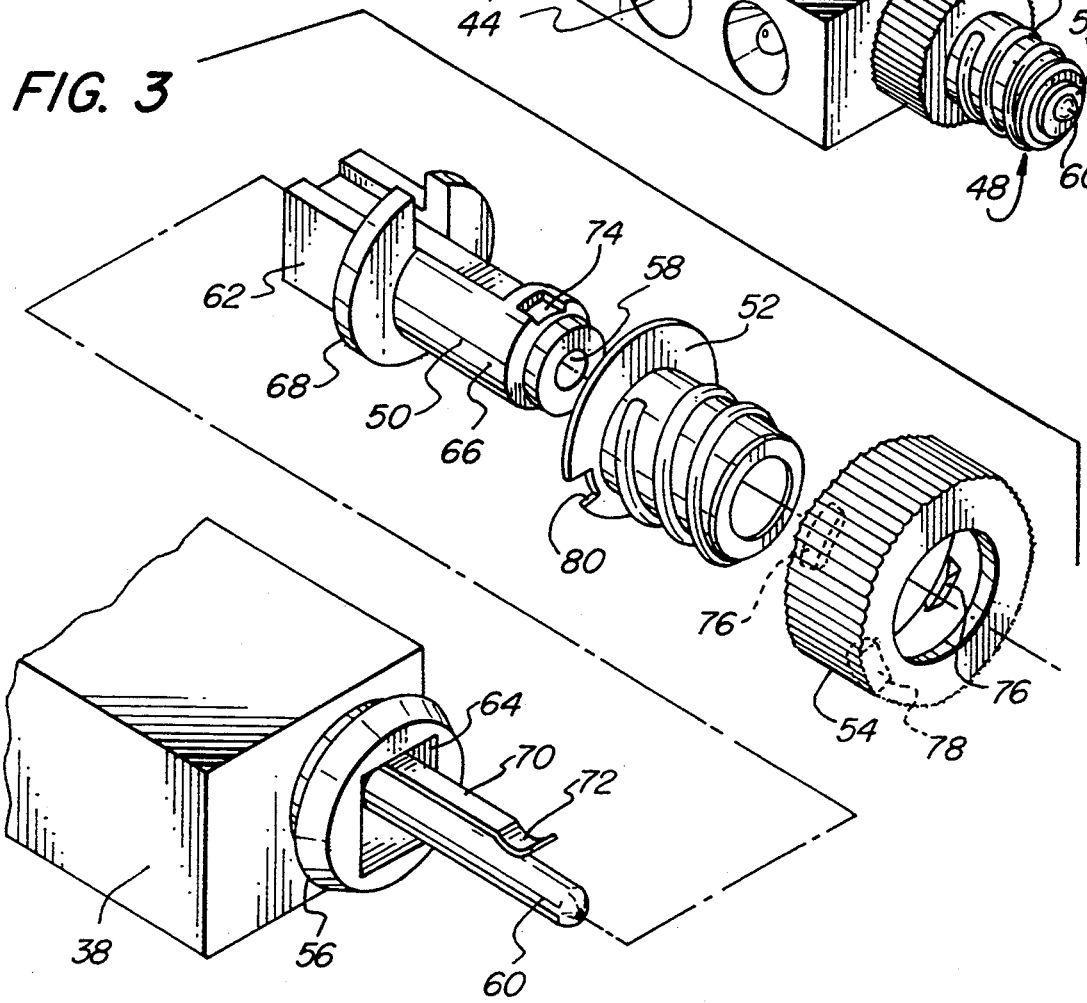

MOUNTING BASE ASSEMBLY FOR A LIGHTING DEVICE USED IN AN EXIT SIGN

BACKGROUND OF THE INVENTION

The present invention relates generally to mounting electrical lighting sources and, more particularly, to mounting and aligning electrical lighting sources in illuminated exit signs.

Under current local fire and building codes, buildings to which the public has access are required to have signage therein identifying the exits. Most of these signs are required to exhibit a specific amount of illumination and, oftentimes, must have an emergency backup power source to provide emergency illumination to the light for a specified period of time during periods when utility power to the building is discontinued, thereby facilitating egress of persons from the building.

Traditionally, two 15-watt incandescent lamps driven by 120 volt alternating current (120 VAC) have been employed to provide normal illumination while two 3.6-watt incandescent lamps driven by a self contained emergency battery power supply are used for illumination during power failure situations. A switching or transfer device will automatically operate the emergency backup illumination system when a power failure is detected.

While these traditional exit sign lighting arrangements perform adequately, they do have a few drawbacks. A major drawback is that the incandescent bulbs use large amounts of electric power thus requiring a relatively large emergency battery power supply for use during emergency lighting situations. Furthermore, while the incandescent bulbs provide adequate illumination, such bulbs do not have a long life in service and require frequent replacement.

To alleviate the drawbacks associated with incandescent bulbs, many manufacturers are beginning to utilize light emitting diodes (LEDs) rather than incandescent bulbs in exit signs. Each light emitting diode provides a relatively small amount of light as compared to the traditional incandescent bulbs whereby a large number of light emitting diodes must be used to provide the same amount of illumination offered by the traditional incandescent bulbs.

It is an object of the present invention to provide a novel mounting base assembly for a plurality of light emitting diodes to properly align the same inside an exit sign.

It is also an object to provide such a mounting base assembly which allows the light emitting diodes to be powered by both the normal utility electrical power (120 VAC) and, during emergency power situations, an emergency battery power supply and associated charging and transfer circuitry.

Still another object is to provide such a mounting base assembly for a plurality of light emitting diodes in an exit sign which maintains electrical continuity when the light emitting diodes are rotated in any given direction.

A further object is to provide such a mounting base assembly for a plurality of light emitting diodes in exit sign which may be readily and economically fabricated and will enjoy a long life in operation.

SUMMARY OF THE INVENTION

It has now been found that the foregoing and related objects can be readily attained in a lighting fixture such as an exit sign having a sign housing defining an enclosure therein, an electrical socket in the sign housing and a lighting device matingly engaged with the electrical socket. The lighting device has a lighting device housing, an plurality of light emitting diodes for providing illumination in the lighting device housing and a mounting base assembly for matingly engaging with the electrical socket while allowing adjustment of the lighting device housing and the light emitting diodes relative to the electrical socket.

According to the invention, the mounting base assembly has an insulator mounted on the lighting device housing for rotation therewith. A first electrical contact is centrally located through the insulator and mounted for rotation therewith while a second electrical contact is mounted for rotation with the insulator and spaced from the first electrical contact. A base member is matingly received in the electrical socket and mounted on the insulator for 360 degree rotation relative thereto. The base member is electrically insulated from the first electrical contact and electrically connected to the second electrical contact.

To retain the base member and the insulator to the lighting device housing, a cap and flange arrangement is provided. The flange is desirably mounted on the lighting device housing and engaged by detents on the cap for retaining the base member and the insulator to the lighting device housing. The base member and the insulator protrude through an opening in the cap. With this arrangement, the base member can be in full mating engagement with the electrical socket while the insulator, the first electrical contact and the second electrical contact can be rotated with the lighting device housing and illumination means without disturbing the full mating engagement of the base member and the electrical socket.

Ideally, the second electrical contact is a cantilevered leaf spring captured between the base member and the insulator. The second electrical contact has a curved end engaging the insulator and biasing the second electrical contact into electrical engagement with the base member.

In accordance with the present invention, a primary electric power circuit is operationally connected to the electrical socket for supplying power to the lighting device while an emergency electric power circuit is operationally connected to the primary electric power circuit to detect failure thereof and thereafter provided auxiliary power to the lighting device through the electrical socket. The emergency electric power circuit includes a plurality of rechargeable batteries and a charging device for keeping the rechargeable batteries fully charged during periods of nonuse.

The invention will be fully understood when reference is made to the following detailed description taken in conjunction with the accompanying drawings.

BRIEF DESCRIPTION OF THE DRAWINGS

FIG. 2 is a perspective view of a light emitting diode lighting device from the exit sign of FIG. 1 which has a mounting base assembly in accordance with the first embodiment of the present invention;

FIG. 3 is an exploded perspective view of the mounting base assembly of FIG. 2;

DETAILED DESCRIPTION OF THE PREFERRED EMBODIMENT

Figure 1:
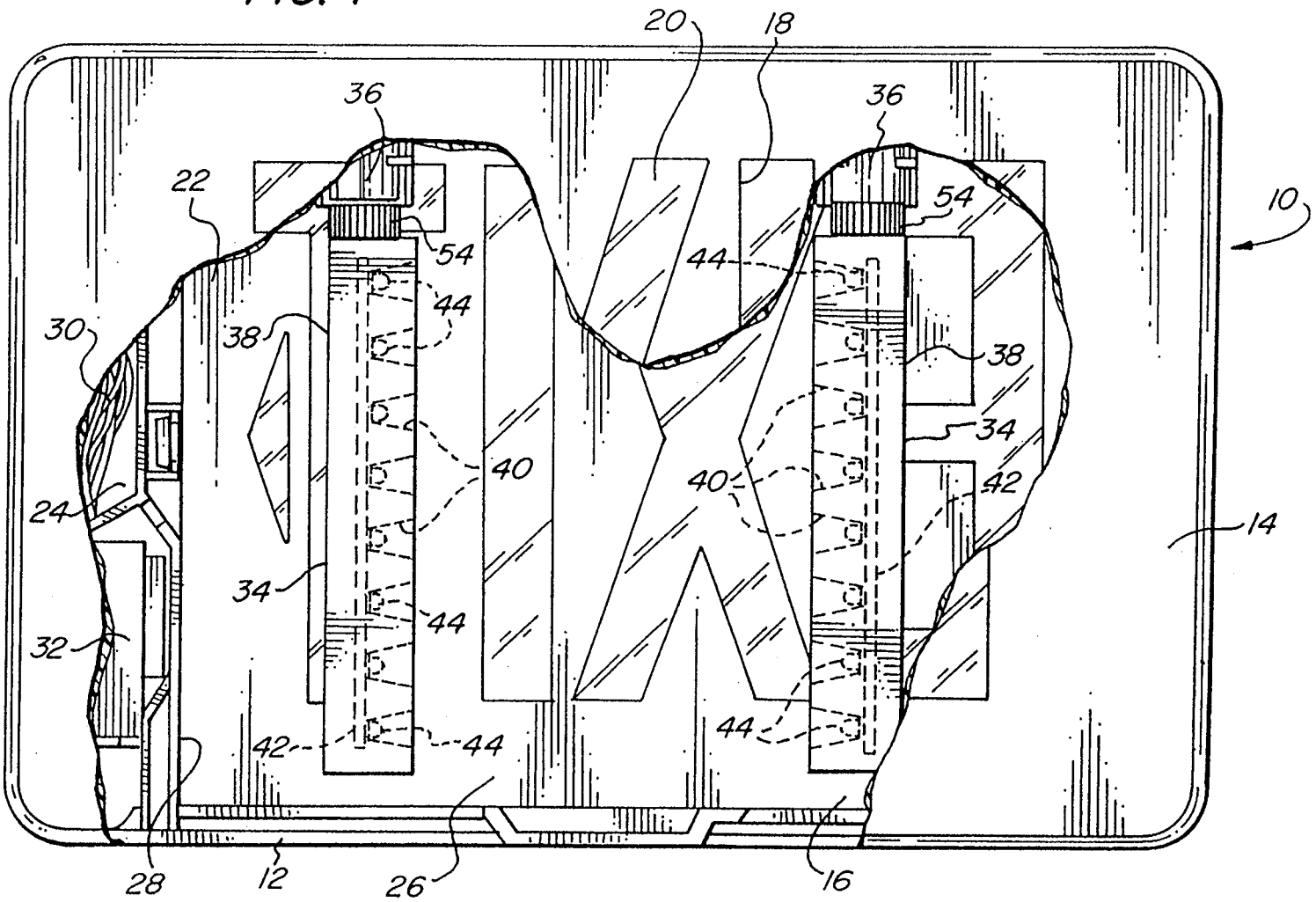
FIG. 1 is a side elevational view of an exit sign housing with portions removed and broken away to illustrate internal structure.

Referring first to FIG. 1 of the drawings, therein illustrated is an exit sign generally designated by the numeral 10. The exit sign 10 is mountable to both a canopy bracket (not shown) and a standard electrical junction box (not shown) in a manner explained in co-pending U.S. patent application Ser. No. 07/925,313, entitled CANOPY MOUNTING DEVICE FOR EXIT SIGNS AND THE LIKE. With this arrangement, the exit sign construction of this invention can be mounted directly to a standard electrical junction box found in a ceiling or wall of a building in any desired location.

The exit sign 10 comprises a central rectangularly shaped frame 12 with front and back cover members 14 and 16, at least one of which incorporates a large stencil 18 having the letters "EXIT" in the major surface thereof and a colored plastic diffuser 20 therebehind. The central rectangularly shaped frame 12 and the front and back cover members 14 and 16 are snap-fit together and cooperate to form an enclosure 22 containing the necessary internal electrical lighting components. The front and back covers 14, 16 can use a plurality of finger clips (not shown) to hold them in assembly with the central rectangularly shaped frame 12. The exit sign 10 is preferably molded from a plastic resin such as an engineering type thermoplastic such as ABS, polycarbonate or polyphelyene oxide but it should be apparent to those skilled in the art that they may be manufactured from other suitable materials.

The enclosure 22 of the exit sign 10 is divided into a wiring compartment 24 and a lighting compartment 26 by a retaining wall 28 which extends around the interior sides and top of the central rectangularly shaped frame 12. The wiring compartment 24 contains an appropriate wiring harness 30 and battery power pack module 32 for powering two 1-watt direct current light emitting diode lighting devices 34 held by standard screw type lamp sockets 36 extending downwardly into the lighting compartment 26 from an upper part of the retaining wall 28. In a manner explained in U.S. patent application Ser. No. 08/160,583 (Ware, Fressola, Van Der Sluys & Adolphson Docket No. 64-152) entitled LIGHTING DEVICE USED IN AN EXIT SIGN by inventor Charles R. Ruskouski, which is hereby incorporated by reference, with particular reference to FIGS. 9 and 9A along with the description thereof, utility power (120 VAC) is provided to the wiring harness 30 of the exit sign 10 through electrical leads (not shown) which extend into an electrical junction box (not shown) found in the ceiling or wall of the building. The utility power is rectified into direct current by appropriate circuitry in the battery power pack module 32 to power the light emitting diode lighting devices 34 through the standard screw-type lamp sockets 36.

The battery power pack module 32 is electrically connected to the wiring harness 30 and incorporates appropriate electronic components and circuitry (not shown) designed in a manner well known to those skilled in the art to charge an auxiliary rechargeable battery pack (not shown) as well as to switch between the primary alternating current power supply and the emergency direct power supply provided by the rechargeable battery pack if the alternating current power supply fails as would be the case during utility power outages.

Referring to FIG. 2 taken in conjunction with FIG. 1, each of the light emitting diode lighting devices 34 has an elongated rectangular plastic housing 38 having a plurality of eight frustoconical apertures 40 along one side thereof. Inside the elongated rectangular plastic housing 38 is a printed circuit board 42 with a plurality of eight light emitting diodes 44 thereon. One of the light emitting diodes is located in each of the frustoconical apertures 40. The light emitting diodes 44 are electrically connected in series, parallel or series parallel to one another through electronic connections (not shown) on the printed circuit board to illuminate the same when powered by the battery pack module 32 through the wiring harness 30. The printed circuit boards 42 are electrically connected to the wiring harness 30 through the screw-type lamp sockets 36 (FIG. 1) by means of mounting base assemblies generally indicated by the numeral 48 (FIG. 2) which are threading received therein.

As illustrated in FIG. 1, in order for light rays from the light emitting diode lighting devices 34 to evenly illuminate the stencil 18 when they pass through the diffuser 20, the frustoconical apertures 40 of the light emitting diode lighting devices 34 with the light emitting diodes 44 therein have to face one another. To align the light emitting diode lighting devices 34 in this fashion, the mounting base assemblies 48 permit adjustment of the elongated rectangular plastic housings 38 relative to the mounting base assemblies 48 once the assemblies 48 are fully inserted and tightened into their respective screw-type lamp sockets 36.

Figure 4:
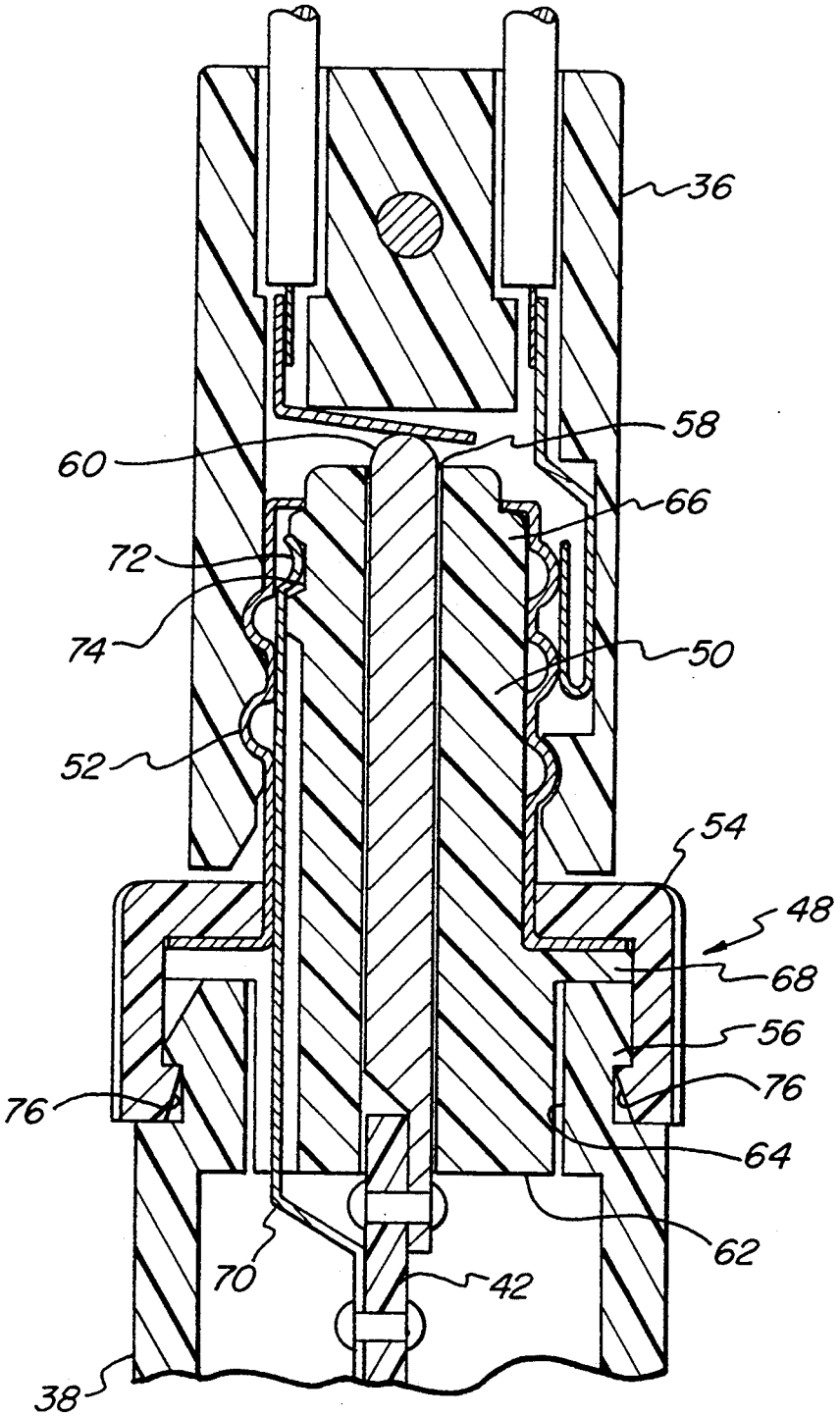
FIG. 4 is a cross-sectional view of the mounting base assembly in full mating engagement with the electrical screw-type socket of the exit sign.

Turning now FIGS. 3 and 4, the adjustment of the elongated rectangular plastic housing 38 relative to the mounting base assembly 48 is accomplished by providing the mounting base assembly 48 with an insulator 50, a brass screw base member 52 and a knurled plastic cap 54 along with a mounting flange 56 on the elongated rectangular plastic housing 38. The insulator 50 is made from an insulative material sold under the tradename VALOX and has an aperture 58 extending therethrough which receives a center electrical contact 60 extending from the printed circuit board 42. One end 62 of the insulator 50 has a rectangular shape fixedly received utilizing an adhesive in a rectangular shaped opening 64 in the mounting flange 56 on the elongated rectangular plastic housing 38. The rectangular shaped end 62 of the insulator 50 is connected to a round barrel shaped end by a transition collar 68. The outside surface of the insulator 50 is flat on one side thereof along which a cantilevered beryllium copper leaf spring electrical contact 70 from the printed circuit board 42 extends. The insulator 50 serves to insulate and separate the cantilevered leaf spring electrical contact 70 from the center electrical contact 60. A free end 72 of the cantilevered leaf spring electrical contact 70 is curved and cooperates with a land portion 74 of the insulator 50 so as to bias the contact 70 into constant electrical engagement with the screw base member 52 which fits over the barrel shaped end 66 of the insulator 50 and sits on the collar 68 of the insulator 50. The contacts 60 and 70 are electrically connected to the light emitting diodes 44.

To retain the various components of the mounting base assembly 48 to one another and the elongated rectangular plastic housing 38, the cap 54 fits over the screw base member 52 and has two diametrically opposed detents 76 on the inside thereof engaging the flange 56 of the housing 38. To prevent relative rotation between the cap 54 and the screw base member 52, a tab 78 (FIG. 3) on the inside of the cap 54 fits into a slot 80 on the screw base member 52. When assembled, the elongated rectangular plastic housing 38, insulator 50, printed circuit board 42, center electrical contact 60 and cantilevered leaf spring electrical contact 70 become one unit rotatable together while the cap 54 and screw base member 52 are rotatable as a unit relative thereto.

In installing the light emitting diode lighting devices 34 into the exit sign 10, the knurled cap 54 of each light emitting diode device 34 can be used to thread the screw base member 52 fully into its associated screw-type socket 36. Once full mating engagement is achieved thereby obtaining appropriate electrical connection between the mounting base assembly 48 and the screw-type socket 36, the elongated rectangular plastic housing 38 can be grasped by the installer and rotated thereby rotating the insulator 50, printed circuit board 42, center electrical contact 60 and cantilevered leaf spring electrical contact 70 for each light emitting diode lighting devices 34 to align the light emitting diode lighting devices 34 as shown in FIG. 1 with the light emitting diodes 44 facing each other to fully illuminating the stencil 18. The cantilevered leaf spring electrical contact 70 maintains electrical continuity with the screw base member 52 in any given direction of rotation of the elongated rectangular plastic housing 38. It should be appreciated by those skilled in the art that the relative tolerances of the components of the light emitting diode lighting devices 34 are such that the light emitting diode lighting devices 34 will not go out of alignment due to inadvertent jarring of the exit sign 10 by the installer.

Figure 5:
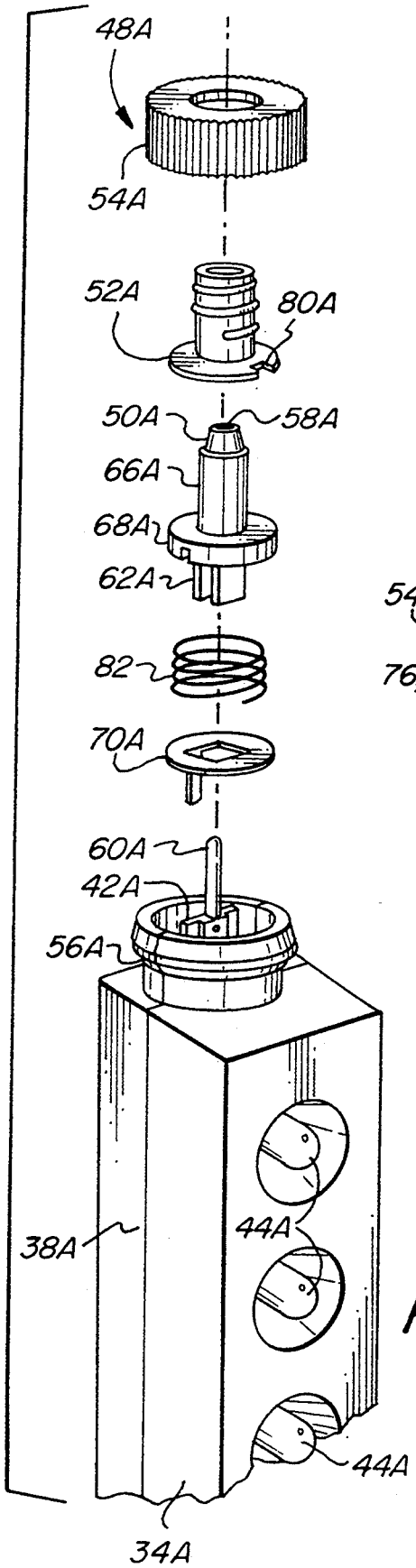
FIG. 5 is an exploded perspective view of a second embodiment of the mounting base assembly.
Figure 6:
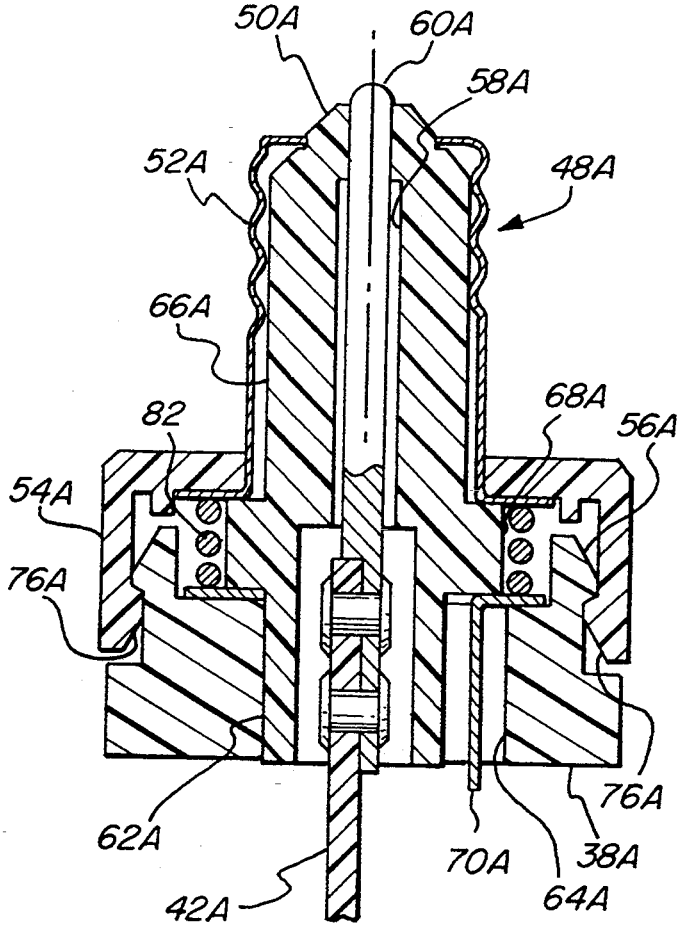
FIG. 6 is a cross-sectional view of the mounting base assembly of FIG. 5.

Turning now to FIGS. 5 and 6, therein is illustrated a second embodiment of the mounting base assembly of the present invention. The components in this second embodiment are similar to the components found in the first embodiment of FIGS. 1–4 and like components have been designated with like reference numerals except for the addition of the reference character A. For example, the mounting base assembly of the second embodiment is generally designated by the numeral 48A.

An elongated rectangular two-part plastic housing 38A for the light emitting diode lighting device 34A can be adjusted relative to the mounting base assembly 48A by providing the mounting base assembly 48A with an insulator 50A, a brass screw base member 52A and a knurled plastic cap 54A along with a mounting flange 56A on the elongated rectangular plastic housing 38A. The insulator 50A is made from an insulative material sold under the tradename VALOX and has an aperture 58A extending therethrough which receives a center electrical contact 60A extending from a printed circuit board 42A. One end 62A of the insulator 50A has a rectangular shape fixedly received utilizing an adhesive in a rectangular shaped opening 64A in the mounting flange 56A on the elongated rectangular plastic housing 38A. The rectangular shaped end 62A of the insulator 50A is connected to a round barrel shaped end 66A by a transition collar 68A.

Surrounding the transition collar 68A is a coil spring contact 82 made of stainless steel or beryllium copper which is sandwiched between the screw base member 52A and a beryllium copper electrical contact 70A. The electrical contact 70A extends to and is electrically connected to the printed circuit board 42A. In the assembled state shown in FIG. 6, the spring contact 82 is under constant compression so as to create a constant electrical engagement between the screw base member 52A, which fits over the barrel shaped end 66A of the insulator 50A and sits on the collar 68A of the insulator 50A, and the electrical contact 70A which sits in the mounting flange 56A. The insulator 50A serves to insulate and separate the screw base member 52A, the coil spring contact 82 and the electrical contact 70A from the center electrical contact 60A. The contacts 60A and 70A are electrically connected to the light emitting diodes 44A through the circuit board 42A.

To retain the various components of the mounting base assembly 48A to one another and the elongated rectangular plastic housing 38A, the cap 54A fits over the screw base member 52A and has two diametrically opposed detents 76A on the inside thereof engaging the flange 56A of the housing 38A. To prevent relative rotation between the cap 54A and the screw base member 52A, a tab (not shown but identical to tab 78 in FIG. 3) on the inside of the cap 54A fits into a slot 80A on the screw base member 52A. When assembled, the elongated rectangular plastic housing 38A, insulator 50A, printed circuit board 42A, center electrical contact 60A and electrical contact 70A become one unit rotatable together while the cap 54A and screw base member 52A are rotatable as a unit relative thereto. During relative rotation of the various components, the coil spring contact 82 would tend to maintain its position thereby creating a sweeping action along the screw base member 52A and the electrical contact 70A to maintain a good electrical connection therebetween. The light emitting diode lighting device 34A is installed into the exit sign 10 in a manner previously described with respect to the first embodiment of FIGS. 1–4.

It will be appreciated by those skilled in the art that the present invention can be modified to be used with other types of electrical sockets such as bayonet-type sockets by modifying the base member.

It will therefore be seen from the above that the present invention provides an effective means for aligning the light emitting diode lighting devices within the housing of the exit sign. The exit sign using the light emitting diode lighting devices has the same amount of illumination as found in exit signs using traditional incandescent lamps while at the same time greatly reducing power consumption.

It will thus be seen that the objects set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the invention which, as a matter of language, might be said to fall therebetween.

What is claimed is:

1. A mounting base assembly for use in a lighting device having a housing and engageable with an electrical socket of a lighting fixture, comprising:

(a) an insulator mounted on the housing of the lighting device for rotation therewith;

(b) a first electrical contact centrally located through said insulator and mounted for rotation therewith;

(c) a second electrical contact mounted for rotation with said insulator and spaced from said first electrical contact;

(d) a base member dimensionally sized to be matingly received in full mating engagement with the electrical socket of the lighting fixture and mounted on said insulator for 360 degree rotation relative thereto, said base member electrically insulated from said first electrical contact and electrically connected to said second electrical contact; and (e) means rotatable with said base member for retaining said base member and said insulator to the housing of the lighting device, whereby said retaining means and said base member can be rotated until full mating engagement of said base member with the electrical socket of the lighting fixture is achieved and thereafter said insulator, said first electrical contact and said second electrical contact can be rotated with the housing of the lighting device relative to and without disturbing the full mating engagement of said base member and the electrical socket.

2. The mounting base assembly in accordance with claim 1, wherein said retaining means includes a cap portion rotatable with the base member and a flange portion, said flange portion being mounted on the housing of the lighting device and being engaged by said cap portion for retaining said base member and said insulator to the housing of the lighting device.

3. The mounting base assembly in accordance with claim 2, wherein said cap portion has an opening through which said base member and said insulator protrude.

4. The mounting base assembly in accordance with claim 2, wherein said cap portion has detents which engage said flange portion.

5. The mounting base assembly in accordance with claim 1, wherein said retaining means has an opening through which said base member and said insulator protrude.

6. The mounting base assembly in accordance with claim 1, wherein said second electrical contact is a cantilevered leaf spring captured between said base member and said insulator.

7. The mounting base assembly in accordance with claim 6, wherein said second electrical contact has a curved end engaging said insulator and biasing said second electrical contact into electrical engagement with said base member.

8. The mounting base assembly in accordance with claim 1, further including a coil spring contact positioned between and electrically connecting said base member and said second electrical contact.

9. A lighting device engageable with an electrical socket of a lighting fixture, comprising:

(a) a housing;

(b) illumination means in said housing;

(c) a mounting base assembly comprising:

(i) an insulator mounted on said housing for rotation therewith;

(ii) a first electrical contact centrally located through said insulator and mounted for rotation therewith;

(iii) a second electrical contact mounted for rotation with said insulator and spaced from said first electrical contact;

(iv) a base member dimensionally sized to be matingly received in the electrical socket of the lighting fixture and mounted on said insulator for 360 degree rotation relative thereto, said base member electrically insulated from said first electrical contact and electrically connected to said second electrical contact; and (v) means rotatable with said base member for retaining said base member and said insulator to said housing, whereby said retaining means and said base member can be rotated until full mating engagement of said base member with the electrical socket of the lighting fixture is achieved and thereafter said insulator, said first electrical contact and said second electrical contact can be rotated with said housing and illumination means without disturbing the full mating engagement of said base member and the electrical socket.

10. The lighting device in accordance with claim 9, wherein said retaining means includes a cap portion and a flange portion, said flange portion being mounted on said housing and being engaged by said cap portion for retaining said base member and said insulator to said housing.

11. The lighting device in accordance with claim 10, wherein said cap portion has an opening through which said base member and said insulator protrude.

12. The lighting device in accordance with claim 10, wherein said cap portion has detents which engage said flange portion.

13. The lighting device in accordance with claim 9, wherein said retaining means has an opening through which said base member and said insulator protrude.

14. The lighting device in accordance with claim 9, wherein said second electrical contact is a cantilevered leaf spring captured between said base member and said insulator.

15. The lighting device in accordance with claim 14, wherein said second electrical contact has a curved end engaging said insulator and biasing said second electrical contact into electrical engagement with said base member.

16. The lighting device in accordance with claim 9, wherein said illumination means are a plurality of light emitting diodes.

17. The lighting device in accordance with claim 9, further including a coil spring contact positioned between and electrically connecting said base member and said second electrical contact.

18. A lighting fixture such as an exit sign, comprising:

(a) a sign housing defining an enclosure therein;

(b) an electrical socket in said sign housing;

(c) a lighting device matingly engaged with said electrical socket and comprising:

(i) a lighting device housing;

(ii) illumination means in said lighting device housing;

(iii) a mounting base assembly comprising:

an insulator mounted on said lighting device housing for rotation therewith;

a first electrical contact centrally located through said insulator and mounted for rotation therewith;

a second electrical contact mounted for rotation with said insulator and spaced from said first electrical contact;

a base member matingly received in full mating engagement with said electrical socket and mounted on said insulator for 360 degree rotation relative thereto, said base member electrically insulated from said first electrical contact and electrically connected to said second electrical contact; and means rotatable with said base member for retaining said base member and said insulator to said lighting device housing, whereby, while said base member is in full mating engagement with said electrical socket, said insulator, said first electrical contact and said second electrical contact can be rotated with said lighting device housing and illumination means relative to and without disturbing the full mating engagement of said base member and said electrical socket.

19. The lighting fixture in accordance with claim 18, wherein said retaining means includes a cap portion and a flange portion, said flange portion being mounted on said lighting device housing and being engaged by said cap portion for retaining said base member and said insulator to said lighting device housing.

20. The lighting fixture in accordance with claim 19, wherein said cap portion has an opening through which said base member and said insulator protrude.

21. The lighting fixture in accordance with claim 19, wherein said cap portion has detents which engage said flange portion.

22. The lighting fixture in accordance with claim 18, wherein said retaining means has an opening through which said base member and said insulator protrude.

23. The lighting fixture in accordance with claim 18, wherein said second electrical contact is a cantilevered leaf spring captured between said base member and said insulator.

24. The lighting fixture in accordance with claim 23, wherein said second electrical contact has a curved end engaging said insulator and biasing said second electrical contact into electrical engagement with said base member.

25. The lighting fixture in accordance with claim 18, wherein said illumination means are a plurality of light emitting diodes.

26. The lighting fixture in accordance with claim 18, further including a primary electric power circuit operationally connected to said electrical socket for supplying power to said lighting device and emergency electric power circuit operationally connected to said primary electric power circuit to detect failure thereof and thereafter provided auxiliary power to said lighting device through said electrical socket.

27. The lighting fixture in accordance with claim 26, wherein said emergency electric power supply is at least one rechargeable battery.

28. The lighting fixture in accordance with claim 27, wherein said emergency electric power circuit includes a charging device for keeping said at least one rechargeable battery fully charged during periods of nonuse.

29. The lighting fixture base assembly in accordance with claim 18, further including a coil spring contact positioned between and electrically connecting said base member and said second electrical contact.

30. A lighting fixture such as an exit sign, comprising:

(a) a sign housing defining an enclosure therein;

(b) an electrical socket in said enclosure of said sign housing;

(c) a lighting device matingly engaged with said electrical socket and comprising:

(i) a lighting device housing;

(ii) illumination means in said lighting device housing;

(iii) a mounting base assembly with a base member matingly received in full mating engagement with said electrical socket and mounted for 360 degree rotation relative to said lighting device housing and said illumination means, and electrical contact means for providing an electrical contact between said illumination means and said electrical socket, whereby, while said base member is in full mating engagement with said electrical socket, said lighting device housing and illumination means can be rotated relative to said base member and said electrical socket without disturbing the full mating engagement thereof and without disturbing the electrical contact between said illumination means and said electrical socket.

31. The lighting fixture in accordance with claim 30, wherein said electrical contact means has a first electrical contact centrally located through said mounting base assembly and electrically insulted from said base member.

32. The lighting fixture in accordance with claim 31, wherein said electrical contact means has a second electrical contact electrically connected to said base member.

33. The lighting fixture in accordance with claim 32, wherein said second electrical contact is a cantilevered leaf spring biased into electrical contact with said base member.

34. The lighting fixture in accordance with claim 30, wherein said illumination means are a plurality of light emitting diodes.

35. The lighting fixture in accordance with claim 30, further including a primary electric power circuit operationally connected to said electrical socket for supplying power to said lighting device and emergency electric power circuit operationally connected to said primary electric power circuit to detect failure thereof and thereafter provided auxiliary power to said lighting device through said electrical socket.

36. The lighting fixture in accordance with claim 35, wherein said emergency electric power supply is at least one rechargeable battery.

37. The lighting fixture in accordance with claim 36, wherein said emergency electric power circuit includes a charging device for keeping said at least one rechargeable battery fully charged during periods of nonuse.

38. The lighting fixture in accordance with claim 32, further including a spring contact positioned between and electrically connecting said base member and said second electrical contact.

* * * * *